United States Patent [19]

Scardera et al.

[11] 4,236,891

[45] Dec. 2, 1980

[54] PROCESS FOR TEXTILE BLEACHING WITH DIBASIC MAGNESIUM HYPOCHLORITE

[75] Inventors: Michael Scardera, Hamden; Garrett B. Schifilliti, Oakville, both of Conn.

[73] Assignee: Olin Corporation, New Haven, Conn.

[21] Appl. No.: 9,316

[22] Filed: Feb. 5, 1979

[51] Int. Cl.[3] ..... D06L 3/08; C11D 3/395

[52] U.S. Cl. ..... 8/108 A; 252/95; 252/100; 252/186

[58] Field of Search ..... 8/108 A; 252/95, 100, 252/186

[56] References Cited

U.S. PATENT DOCUMENTS

| | | | |
|---|---|---|---|
| 2,691,637 | 10/1954 | Waibel | 8/108 A |
| 2,947,700 | 8/1960 | Waibel | 8/108 A |
| 3,065,040 | 11/1962 | Waibel | 8/108 A |
| 3,582,265 | 6/1971 | Bishop et al. | 23/50 |
| 4,123,377 | 10/1978 | Davey et al. | 252/95 |

*Primary Examiner*—John Kight, III

*Attorney, Agent, or Firm*—James B. Haglind; Donald F. Clements

[57] ABSTRACT

Textile fabrics are bleached in a process which comprises contacting the textiles with an aqueous solution of dibasic magnesium hypoclorite. The bleaching solution is maintained at a pH of from about 3 to about 8 by the addition of an acid or acid salt.

7 Claims, 1 Drawing Figure

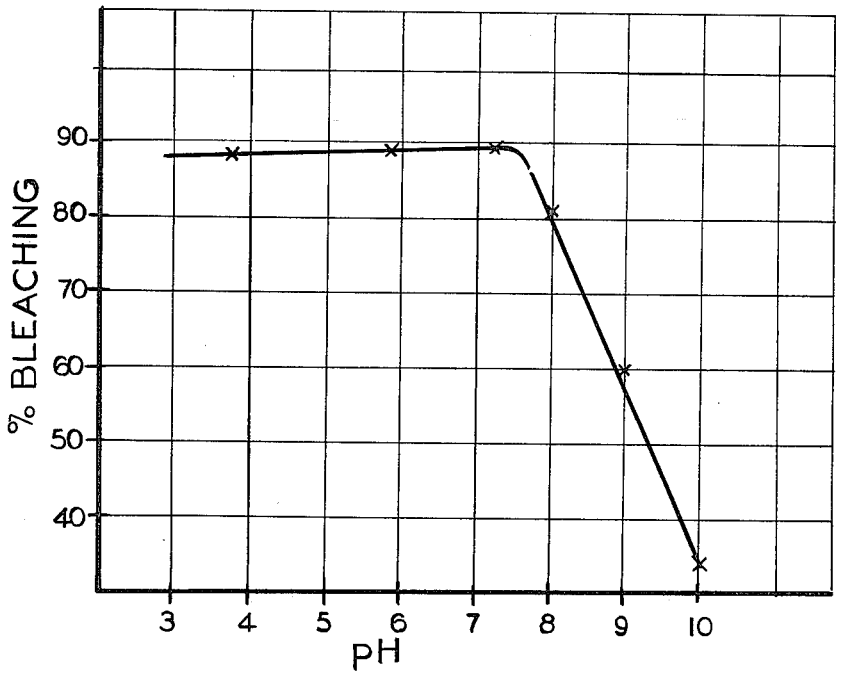
% BLEACHING
90
80
70
60
50
40
3
4
5
6
7
8
9
10
PH

PROCESS FOR TEXTILE BLEACHING WITH DIBASIC MAGNESIUM HYPOCHLORITE

This invention relates to the bleaching of textile fabrics. More particularly, this invention relates to the bleaching of fabrics with dibasic magnesium hypochlorite.

Bleaching of textile fabrics with solid chlorine-containing compounds such as calcium hypochlorite or sodium chlorite has been practiced for many years. Calcium hypochlorite has had limited use as it can produce pinholes in fabrics. The use of sodium chlorite in bleaching processes requires the generation of chlorine dioxide which is toxic to humans and corrosive to equipment.

It is an object of the present invention to provide a process for bleaching textiles which avoids producing pinholes in the materials.

Another object of the present invention is to provide a process for bleaching textiles which avoids producing a toxic gas.

These and other objects of the invention are accomplished in a process for bleaching textiles which comprises contacting said textiles with an aqueous solution of dibasic magnesium hypochlorite, said aqueous solution being maintained at a pH of from about 3 to about 8.

Dibasic magnesium hypochlorite is a solid compound having an available chlorine content in the range of from about 50 to about 60 percent. It can be produced, for example, by the reaction of an aqueous solution of a hypochlorite such as calcium hypochlorite with an aqueous solution of a magnesium salt such as magnesium chloride or magnesium nitrate. This method of preparation is described in U.S. Pat. No. 3,582,265 issued June 1, 1971, to J. J. Bishop et al.

Another process for producing dibasic magnesium hypochlorite reacts a solid magnesium salt with a solid hypochlorite salt where one of the salts is in the hydrate form. This process is described in U.S. Pat. No. 4,071,605, issued Jan. 31, 1978, to J. A. Wojtowicz.

Either of these processes may be used to produce the dibasic magnesium hypochlorite used as a bleaching agent in the process of the present invention.

The dibasic magnesium hypochlorite is employed as an aqueous solution which is maintained at a pH in the range of from about 3 to about 8 and preferably from about 3.5 to about 7.5. As a natural pH of an aqueous solution of dibasic acid magnesium chloride is about 10, the aqueous solution to be used for bleaching is acidified with an acid or and acid salt.

Suitable acids include inorganic acids such as phosphoric acid, hydrochloric acid, sulfuric acid, nitric acid, or boric acid, as well as organic acids such as formic acid, acetic acid, citric acid, tartaric acid, or nitrilotriacetic acid. Mixtures of inorganic acids and organic acids may be used, if desired.

The pH range of the aqueous solution of dibasic magnesium hypochlorite may be maintained by the addition of an acid salt including, for example, an alkali metal bisulfate, such as sodium bisulfate or an alkali metal acid phosphate such as sodium dihydrogen phosphate or disodium hydrogen phosphate.

The novel process of the present invention can be used in bleaching textiles produced from natural fibers such as cotton, synthetic fibers including those of cellulose acetate, cellulose triacetate, rayon, viscose, polyesters, polyacrylonitrile, polypropylene, polyurethane, and polyvinyl chloride or mixtures thereof. In a preferred embodiment, cotton textiles including cotton-polyester blends are bleached by the process of the present invention.

Various forms of textiles may be bleached including fluffs, fabrics, ribbons, napes, etc.

The textiles are bleached by contacting them with the aqueous solution of dibasic magnesium hypochlorite, for example, by immersing the textiles in the aqueous solution. Bleaching takes place at any suitable temperature such as those in the range of from about 10° to about 100° C., and preferably from about 30° to about 80° C. Textiles are held in contact with the aqueous solution of dibasic magnesium hypochlorite for a period of time sufficient to provide the materials with the desired degree of bleaching.

Aqueous solutions of dibasic magnesium hypochlorite may contain any suitable amount of the bleaching agent. For example, aqueous solutions containing amounts of dibasic magnesium hypochlorite which provide available chlorine concentrations in the range of from about 0.001% to about 0.1% may be employed. If desired, however, solutions containing greater or lesser available chlorine concentrations may be used.

Following bleaching, the textiles may be washed in water. If it is necessary to remove or destroy residual chlorine, the bleaching textiles may be treated with solutions of an "antichlor" such as sodium thiosulfite or sodium bisulfite.

The process of the present invention may also be used in pre-soaking articles prior to their being washed in a home laundry operation. Items to be washed are immersed in an aqueous solution of the dibasic magnesium hypochlorite which has been acidified by the addition of an acid or an acid salt to provide the desired pH range of from about 3 to about 8. The solution is maintained at a temperature of from about 10° to about 80° C. Following the pre-soaking period, the items to be washed may be squeezed or wrung to remove excess bleaching solution therefrom. In a preferred embodiment, predetermined amounts of dibasic magnesium hypochlorite and a solid acid or acid salt are blended to provide a mixture which may be added directly to water to conveniently provide a pre-soaking solution containing dibasic magnesium hypochlorite at a pH in the desired range.

To further illustrate the novel process of the present invention, the following examples are presented.

EXAMPLES 1–4

One liter of hot distilled water was added to each of 6 containers of a Terg-O-Tometer (U.S. Testing Company). To the water in each container was added 0.3 grams of dibasic magnesium hypochlorite (51 percent available chlorine; particle size range from about 150 microns to less than 50 microns) prepared by the process of U.S. Pat. No. 4,071,605. Phosphoric acid was admixed with the bleaching solutions in 5 of the 6 containers in amounts sufficient to provide the desired pH value. A heating bath maintained the temperature of the bleaching solution in each bath at about 50° C. Two cotton cloths (Testfabrics, Inc. EMPA 115 bleach test cloth) were placed in each container and bleached for ten minutes with the solution being agitated during the bleaching period. The bleached cloths were rinsed in distilled water for 5 minutes, dried and ironed flat. Reflectance measurements were made on each cloth (Hunter Labs, Fairfax, Virginia D24D color differencemeter) and the percent of bleaching calculated. Testing results are given in Table 1 below.

TABLE 1

BLEACHING WITH DIBASIC MAGNESIUM HYPOCHLORITE

| Example No. | pH of Bleach Solution | % Bleaching |
|---|---|---|
| Control | 10 | 34.5 |
| A | 9.0 | 59.9 |
| 1 | 8.0 | 81.0 |
| 2 | 7.3 | 89.9 |
| 3 | 5.8 | 89.8 |
| 4 | 3.8 | 88.7 |

The results show the high degree of bleaching with dibasic magnesium hypochlorite at pH values in the range of 3 to 8 when compared to the Control and Comparative Example A. These results are illustrated in graphic form in the FIGURE.

What is claimed is:

1. A process for bleaching textiles which comprises contacting said textiles with an aqueous solution of dibasic magnesium hypochlorite, the pH of said aqueous solution being maintained at from about 3.5 to about 7.5 by the addition of an acid compound.

2. The process of claim 1 in which said acid compound is an inorganic acid selected from the group consisting of phosphoric acid, hydrochloric acid, sulfuric acid, nitric acid, and boric acid.

3. The process of claim 1 in which said acid compound is an organic acid selected from the group consisting of formic acid, acetic acid, citric acid, tartaric acid, and nitrilotriacetic acid.

4. The process of claim 1 in which said acid compound is a salt selected from the group consisting of alkali metal bisulfates and alkali metal acid phosphates.

5. The process of claim 2 in which said inorganic acid is phosphoric acid.

6. The process of claim 1 in which the temperature of said aqueous solution is maintained at from about 10° to about 100° C.

7. The process of claim 6 in which said textiles are cotton textiles.

* * * * *